US005466120A

United States Patent [19]

Takeuchi et al.

[11] Patent Number: 5,466,120

[45] Date of Patent: Nov. 14, 1995

[54] BLOWER WITH BENT STAYS

[75] Inventors: Kazuhiro Takeuchi, Okazaki; Akira Yamanaka, Gifu, both of Japan

[73] Assignee: Nippondenso Co., Ltd., Kariya, Japan

[21] Appl. No.: 219,838

[22] Filed: Mar. 30, 1994

[30] Foreign Application Priority Data

Mar. 30, 1993 [JP] Japan ..... 5-072582
Mar. 30, 1993 [JP] Japan ..... 5-072584

[51] Int. Cl.[6] ..... F04D 29/66

[52] U.S. Cl. ..... 415/119; 415/191

[58] Field of Search ..... 415/119, 208.1, 415/183, 191, 914

[56] References Cited

U.S. PATENT DOCUMENTS

| | | | |
|---|---|---|---|
| 2,154,313 | 4/1939 | McMahan | 415/191 |
| 3,995,970 | 12/1976 | Yamaguchi | 415/119 |
| 4,636,669 | 1/1987 | Plunkett et al. | 415/119 |
| 4,761,115 | 8/1988 | Hopfensperger | 415/119 |
| 5,118,252 | 6/1992 | Chney | 415/119 |
| 5,259,726 | 11/1993 | Bacria | 415/119 |

FOREIGN PATENT DOCUMENTS

| | | |
|---|---|---|
| 4106378 | 8/1992 | Germany . |
| 58-070099 | 4/1983 | Japan . |
| 60-175900 | 11/1985 | Japan . |
| 61-014713 | 1/1986 | Japan . |
| 61-204999 | 12/1986 | Japan . |
| 1110900 | 4/1989 | Japan . |

*Primary Examiner*—John T. Kwon
*Attorney, Agent, or Firm*—Cushman Darby & Cushman

[57] ABSTRACT

A blower comprising an axial-flow fan covered by a cylindrical shroud and a motor for driving the fan. The motor is supported by radially extending stays at the central region of the fan on the suction side of the fan. The stays are integrally formed with a central support for the motor and an outer cylindrical shroud covering the fan. Each of the stays is bent and subdivided into an outer portion near the shroud and an inner portion near the support ring. The outer portion extends along a radial line about the axis of the fan, and the inner portion extends at an inclination to a radial line about the axis of the fan so as to reduce noise induced when air passes through the stays and the fan. The blower can also include a protection net comprising annular ribs circumferentially interconnecting the adjacent stays. Each of the annular ribs has a streamlined cross-sectional shape. The center line of the inner annular ribs is arranged in parallel to the axis of the fan, and the center line of the outer annular ribs is arranged at an inclination to the axis of the fan.

7 Claims, 10 Drawing Sheets

BLOWER WITH BENT STAYS

BACKGROUND OF THE INVENTION

1. Field of the Invention

The present invention relates to a blower including an axial-flow fan and an electric motor supported by stays which are arranged on the suction side of the fan.

2. Description of the Related Art

A typical blower including an axial-flow fan and an electric motor supported by stays on the suction side of the fan is shown in FIG. 11 of the attached drawings. The blower 100 comprises an axial-flow fan 103 having five vanes 102 with radially extending leading edges 101, and an electric motor 104 for driving the fan 103. The motor 104 is supported by twelve radially extending stays 105 arranged on the suction side of the fan 103.

In this blower 100, when the motor 104 is activated, the fan 103 draws air from the suction side thereof through openings between the stays 105. Air flows past the stays 105 and a turbulence occurs in air flow on the downstream side of the stays 105. The turbulence in air flow reaches the rotating vanes 102, and induces an interference noise when air passes between the vane 102.

In the blower 100 of FIG. 11, since the relative angle between the leading edges 101 of the vanes 102 and the stays 105 is substantially constant along the length of the stays 105, the interference noise occurs the instant when the vane 102 passes the stays 105. The fan noise in this arrangement is shown by the curve B in FIG. 12, in which the interference noise having large peaks B1 appears at basic frequencies comprising the product of the number of the vanes 102 and the rotational speed of the fan 103.

Therefore, a proposal has been made to the blower 100 such that the stays 105 are arranged at an inclination to a radial line about the axis of the fan 103 so as to disperse the interference between the stays 105 and the vanes 102 during an extended time period, as shown in FIG. 13. The fan noise in this arrangement is shown by the curve C in FIG. 12, in which peaks C1 of the interference noise is reduced.

In this type of blower 100, the axial-flow fan 103 draws a majority of air generally in the direction of the axis of the fan 103, and in addition, a certain amount of air is also drawn in the fan 103 in the radial direction of the fan 103 in the outer peripheral region of the fan 103, as shown in FIG. 14. If the stay 105 is arranged at an inclination to a radial line about the axis of the fan 103, the direction of incoming air flow is not parallel to the stay 105 so that a large turbulence occurs in air flow on the trailing side of the outer portion of the stay 105. As a result, in the blower 100 of FIG. 13, peaks C1 of the noise can be reduced but the noise C as a total may be more rather than the noise B induced by the blower 100 of FIG. 11.

The blower 100 can also include annular ribs circumferentially interconnecting the radially extending stays so as to form a protection net. A similar problem arises in the annular ribs, when air is drawn into the fan 103 from the outer periphery of the fan.

SUMMARY OF THE INVENTION

The object of the present invention is to provide a blower by which a noise induced by air flow passing through the blower can be reduced, and especially the total noise and peaks of the noise can be reduced.

According to the present invention, there is provided a blower comprising an axial-flow fan having an axis, a plurality of vanes arranged about said axis and defining an outer periphery of the fan, and a suction side; driving means for driving the fan for inducing a flow of air through the fan; support means for supporting the driving means at a central region of the fan; a generally cylindrical shroud covering the outer periphery of the fan; and a plurality of bent stays arranged on the suction side of the fan and integrally formed with the support means and the shroud for connecting the support means to the shroud. The present invention is characterized in that each of the stays comprises an outer portion near the shroud extending along a radial line about the axis of the fan, and an inner portion near the support means extending at an inclination to a radial line about the axis of the fan.

In this arrangement, when the motor is actuated for rotating the fan, the fan draws air from the suction side thereof through openings between the stays. A majority of air flows in the fan in the direction of the axis of the fan and a certain amount of air also flows in the fan in the radial direction of the fan in the outer peripheral region of the fan. The outer portion of each of the stay extends along a radial line about the axis of the fan, and so the direction of incoming air flow is parallel to the outer portion of the stay. Accordingly, a turbulence in air flow in the outer peripheral region of the fan can be reduced compared with the prior art in which the stay extends at an inclination to a radial line about the axis of the fan.

In addition, the inner portion of the stay near the support means extends at an inclination to a radial line about the axis of the fan, but air in this area flows in the direction of the axis of the fan equally along both surfaces of the stay. Therefore, a turbulence in air flow is small in this area. The inner portion of the stay is arranged at an inclination to a radial line about the axis of the fan, so that the intersecting point of the leading edge of the vane to the stay changes during an extended time period. Therefore, peaks of the noise caused by interference of the leading edges of the vane with the stays can be reduced.

Preferably, the inner portion of each of the stays is inclined to a radial line about the axis of the fan toward the side opposite to a rotational direction of the fan, or toward the side in a rotational direction of the fan.

Preferably, each of the vanes has a leading edge in view of air flow, the leading edge being arranged such that the leading edge intersects the outer and inner portions of the stays, respectively, at a relative angle between the leading edge and the stay, the relative angle being equal to or greater than a predetermined angle, preferably 30 degrees.

In addition to these arrangements, it is possible to provide a plurality of annular members integrally formed with the stays for circumferentially interconnecting the adjacent stays; each of the annular members having a streamlined cross-sectional shape with a round leading end and a sharp trailing end in view of air flow, each of the annular members having a center line passing through the leading end and the trailing end; and the center line of at least one of the annular member located near the support means being arranged in parallel to the axis of the fan, the center line of at least one of the annular member located near the shroud being arranged at an inclination to the axis of the fan toward the shroud.

Preferably, in this case, the center line of a plurality of annular members located near the shroud are arranged at an inclination to the axis of the fan toward the shroud, and the angle of inclination is greater as the position of the annular member is located nearer the shroud.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
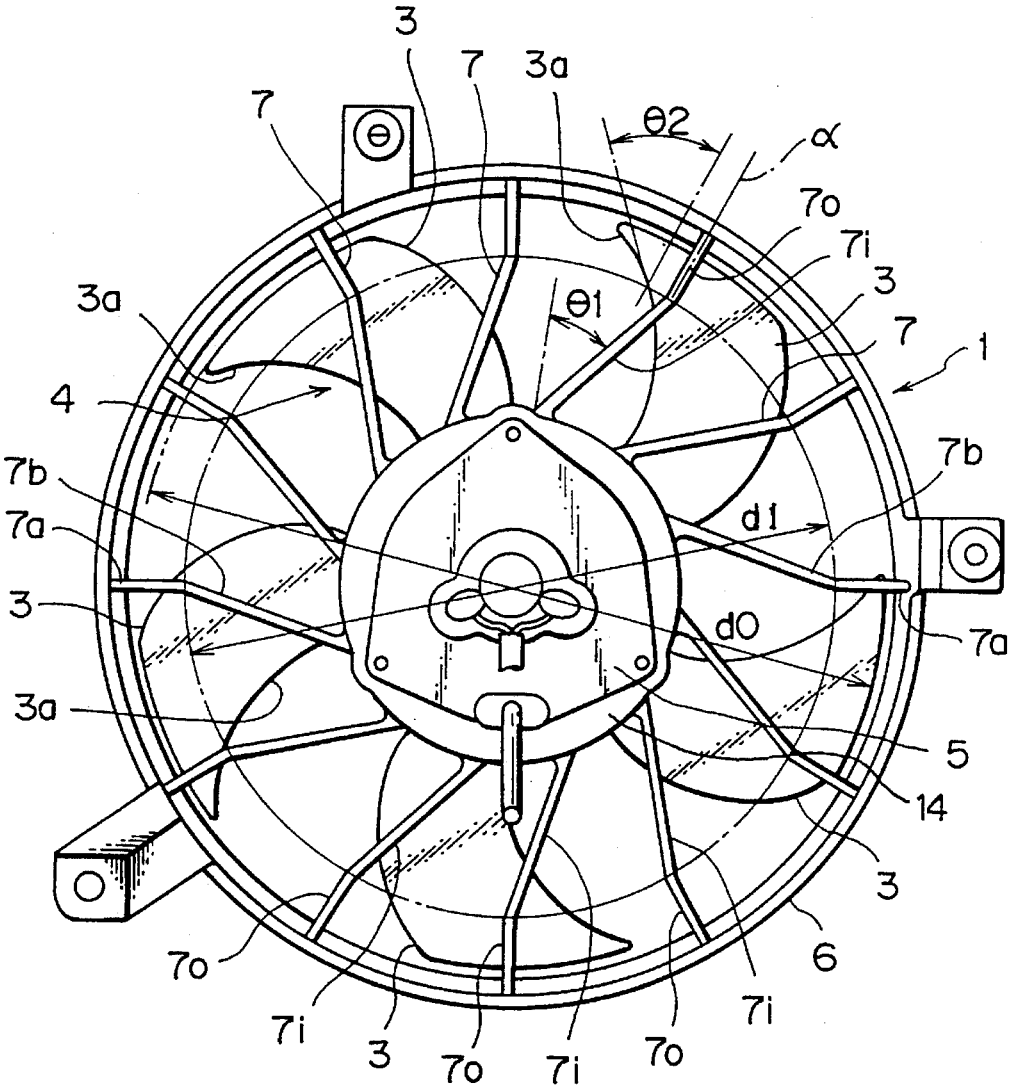
FIG. 1 is a front view of the blower according to the first embodiment of the present invention.

FIGS. 1 to 4 show a blower 1 of the first embodiment of the present invention. The blower 1 is a forced draft type blower for supplying air to a heat exchanger 2 such as a coolant condenser or a radiator with the blower 1 located at the front of an automobile. The blower 1 comprises an axial-flow fan 4 with five vanes 3, an electric motor 5 for driving the fan 4 when a voltage is supplied to the motor 5, a generally cylindrical shroud 6 covering the outer periphery of the fan 4, and twelve stays 7 integrally formed with the shroud 6 by a plastic moulding for supporting the motor 5 on the suction side of the fan 4. An annular support 14 is also integrally formed with the stays 7 for supporting the motor 5 which is secured to the support 14 by engaging screws 16 into threaded holes 15 of the support 14.

Each stay 7 comprises a leg **7*a* extending from the shroud 6 on the suction side of the fan 4 in parallel to the axis of the fan 4, and a radial rib 7*b* extending radially inwardly from the leg 7*a*. Each stay 7 is formed in a bullet-like cross-sectional shape with a round leading end in view of air flow. The radial rib 7*b* has a longitudinal axis extending in parallel to the axis of the fan 4, and the leg 7*a* has a longitudinal axis extending radially inwardly of the fan 4**.

Each stay 7 is bent and subdivided into an outer portion **7*o* near the outer periphery of the fan 4 and an inner portion 7*i* extending inwardly from the outer portion 7*o* toward the central support 14. The outer portion 7*o* is a portion of the stay 7 arranged at such a position that when the fan 4 draws air, air flows relatively intensively in the radially inward direction. The outer portion 7*o* includes the leg 7*a* and a portion of radial rib 7*b*. The inner portion 7*i* is a portion of the stay 7 arranged at such a position that when the fan 4 draws air, air flows generally in parallel to the axis of the fan 4. The boundary d1 between the outer and inner portions 7*o* and 7*i* is in the range determined by the relationship of $d1 \geqq d0 \times 0.8$, where d0 is the diameter of the fan 4**.

The outer portion **7*o* of the stay 7 is arranged along a radial line α about the axis of the fan 4. The inner portion 7*i* of the stay 7 is arranged at an inclination to a radial line α toward the side in reverse to a rotational direction of the fan 4. The angle θ1 of inclination between the inner portion 7*i* and the radial line α is selected such that, the inner portion 7*i* and the leading edge 3*a* of the vane 3 form an angle in the range of approximately 30 to 60 degrees, even if the leading edge 3*a* of the vane 3 is arranged along the radial line α, and in the embodiment, the angle θ1** of inclination is 30 degrees.

The axial-flow fan 4 includes a boss 9 driven by the motor 5, and five vanes 3 are radially attached to the boss 9. Each vane 3 is formed in a sweep-forward shape with the leading edge **3*a* advancing in the rotational direction of the fan 4**.

The angle of inclination of the leading edge **3*a* in the rotational direction of the fan 4 (angle between the radial line α and the leading edge 3*a*) becomes larger from the juncture of the vane with the support 14 to the free end thereof, and the angle of inclination θ2 at the boundary d1 between the outer and inner portions 7*o* and 7*i* is determined so that the relative angle between the outer portion 7*o* of the stay 7 and the leading edge 3*a* of the vane 3 is greater than 30 degrees. The angle of inclination θ2** in the embodiment is 30 degrees.

Therefore, the relative angle between the inner portion **7*i* of the stay 7 and the leading edge 3*a* of the vane 3 is always greater than 30 degrees, and the relative angle between the outer portion 7*o* of the stay 7 and the leading edge 3*a* of the vane 3** is always greater than 30 degrees.

In operation, when a voltage is supplied to the motor 5, the axial-flow fan 4 draws air from openings between the stays 7 to blow the drawn air to the heat exchanger 2.

Figure 2:
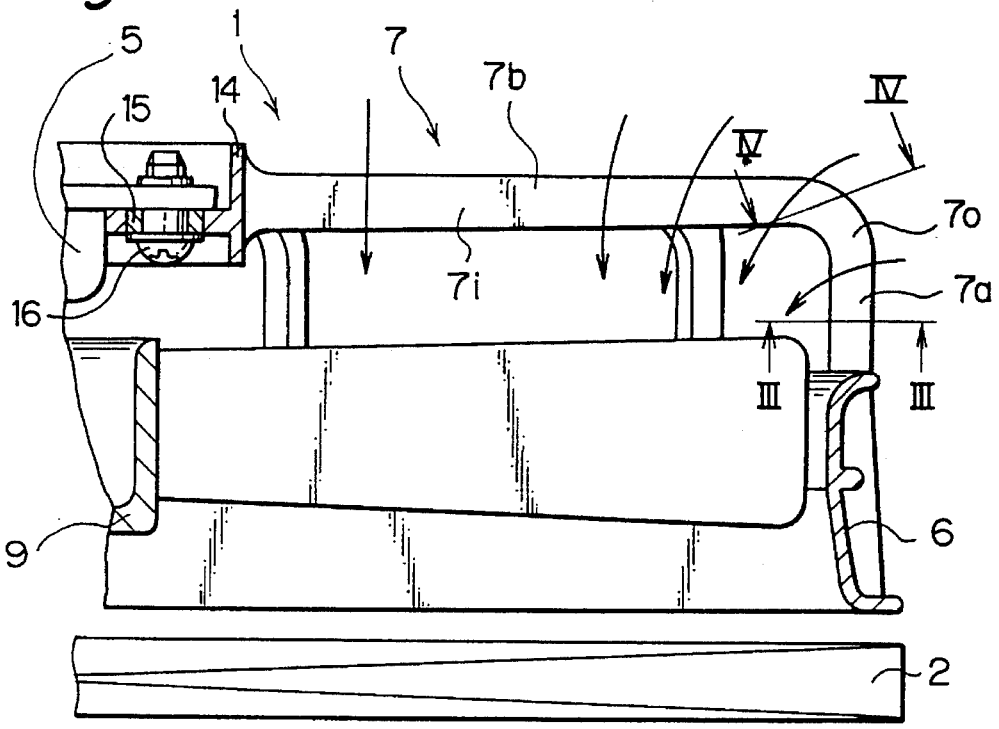
FIG. 2 is a partial, enlarged cross-sectional view of the blower of FIG. 1.

The flow of air drawn by the fan 4 is shown by the arrows in FIG. 2. A portion of air flows radially inwardly in the fan 4 at the outer portion **7*o* of the fan 4, and another portion of air flows in parallel to the axis of the fan 4 at the inner portion 7*i* of the fan 4**.

Figure 3:
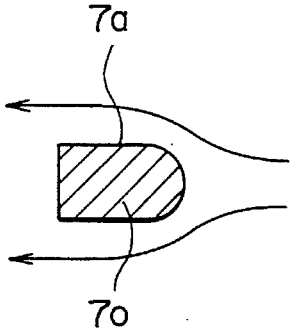
FIG. 3 is a cross-sectional view of the blower of FIG. 2 along the lines III—III in FIG. 2.
Figure 4:
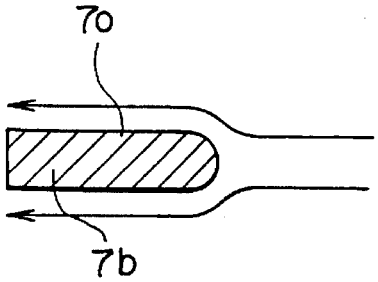
FIG. 4 is a cross-sectional view of the blower of FIG. 2 along the lines IV—IV in FIG. 2.

The flow of air in the radial direction is a flow along a radial line about the axis of the fan 4, and thus air flows along the outer portion **7*o* of the stay 7, as shown in FIGS. 3 and 4. Therefore, turbulence in the air flow on the downstream side of the outer portion 7*o* of the stay 7** is reduced.

In addition, the inner portion **7*i* of the stay 7 is arranged at an angle of inclination of 30 degrees to a radial line α about the axis of the fan 4, but the air in this area flows in the direction of the axis of the fan 4 equally along both surfaces of the inner portion 7*i* of the stay 7**. Therefore, the turbulence in the air flow is small in this area.

Also, the inner portion **7*i* of the stay 7 is arranged at an angle of inclination of 30 degrees toward the side opposite to the rotational direction of the fan 4, and so the leading edge 3*a* of the vane intersects with the stay 7 at a relative angle greater than 30 degrees. Therefore, the intersecting point of the leading edge 3***a* of the vane 3 to the stay 7 changes during an extended time period and thus peaks of the noise caused by interference of the leading edges 3*a* of the vane 3 with the stays 7 can be reduced.

Also, the leading edge 3*a* of the vane 3 intersecting with the outer portion 7*o* of the stay 7 is arranged at an angle of inclination greater than 30 degrees toward the rotational direction of the fan 4, and thus the leading edge 3*a* of the vane intersect with the outer portion 7*o* of the stay 7 at a relative angle greater than 30 degrees. Therefore, the intersecting point of the leading edge 3*a* of the vane 3 to the outer portion 7*o* the stay 7 changes during an extended time period and thus peaks of the noise caused by interference of the leading edges 3*a* of the vane 3 with the outer portion 7*o* of the stays 7 can be reduced.

Figure 5:
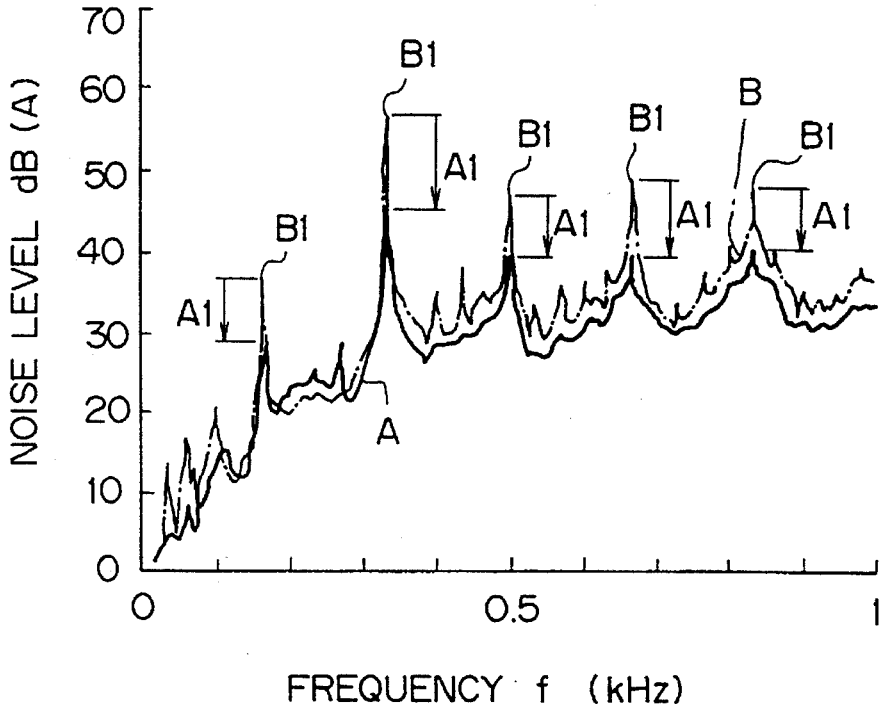
FIG. 5 is a view illustrating the relationships between the fan noise level and the frequency of the blower of the present invention and of a prior art.
Figure 6:
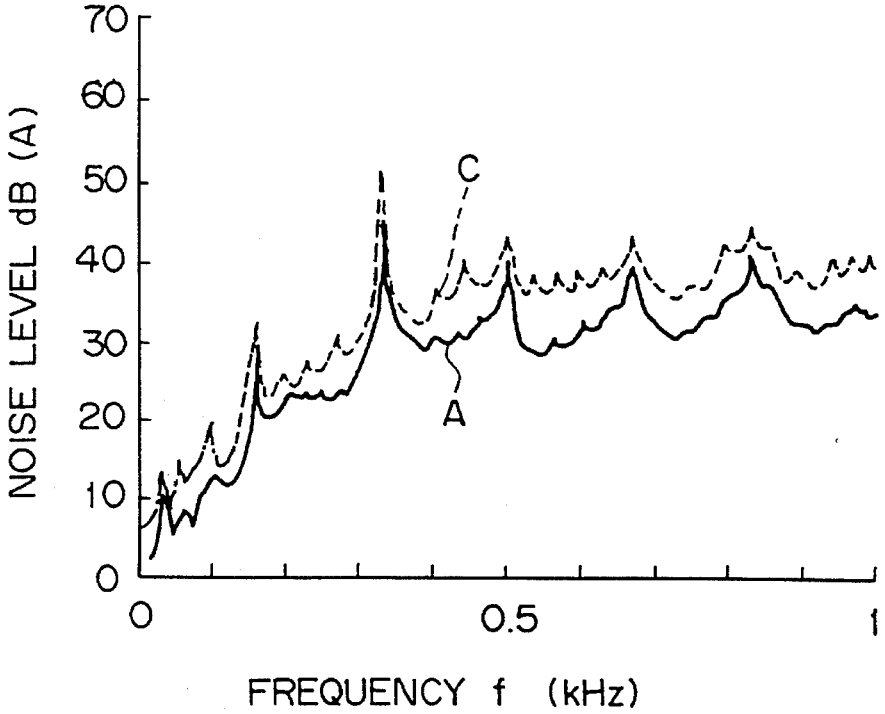
FIG. 6 is a view similar to FIG. 5, illustrating the relationships between the fan noise level and the frequency of the blower of the present invention and of another prior art.
Figure 11:
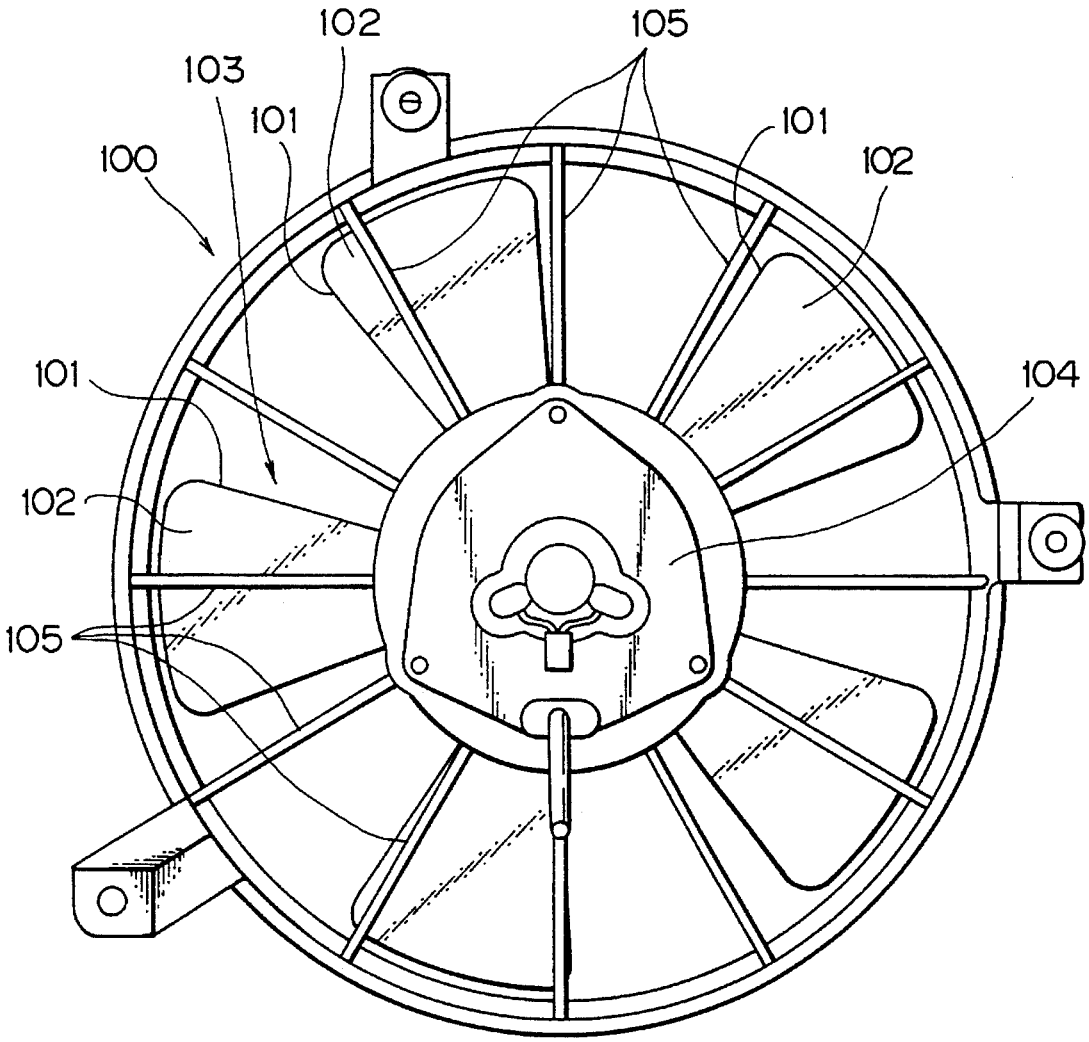
Fig. 11 PRIOR ART
FIG. 11 is a front view of a prior art.
Figure 12:
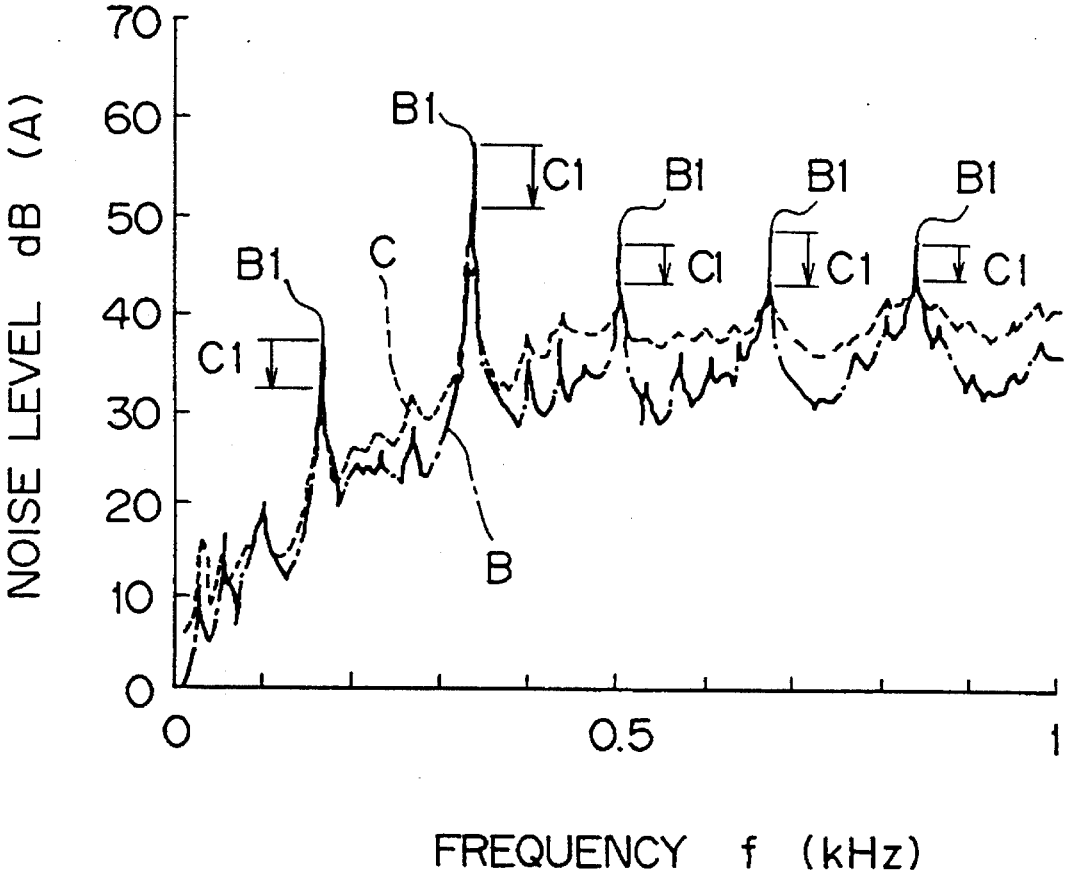
Fig.12 PRIOR ART
FIG. 12 is a view illustrating the relationships between the fan noise level and the frequency of prior arts.
Figure 13:
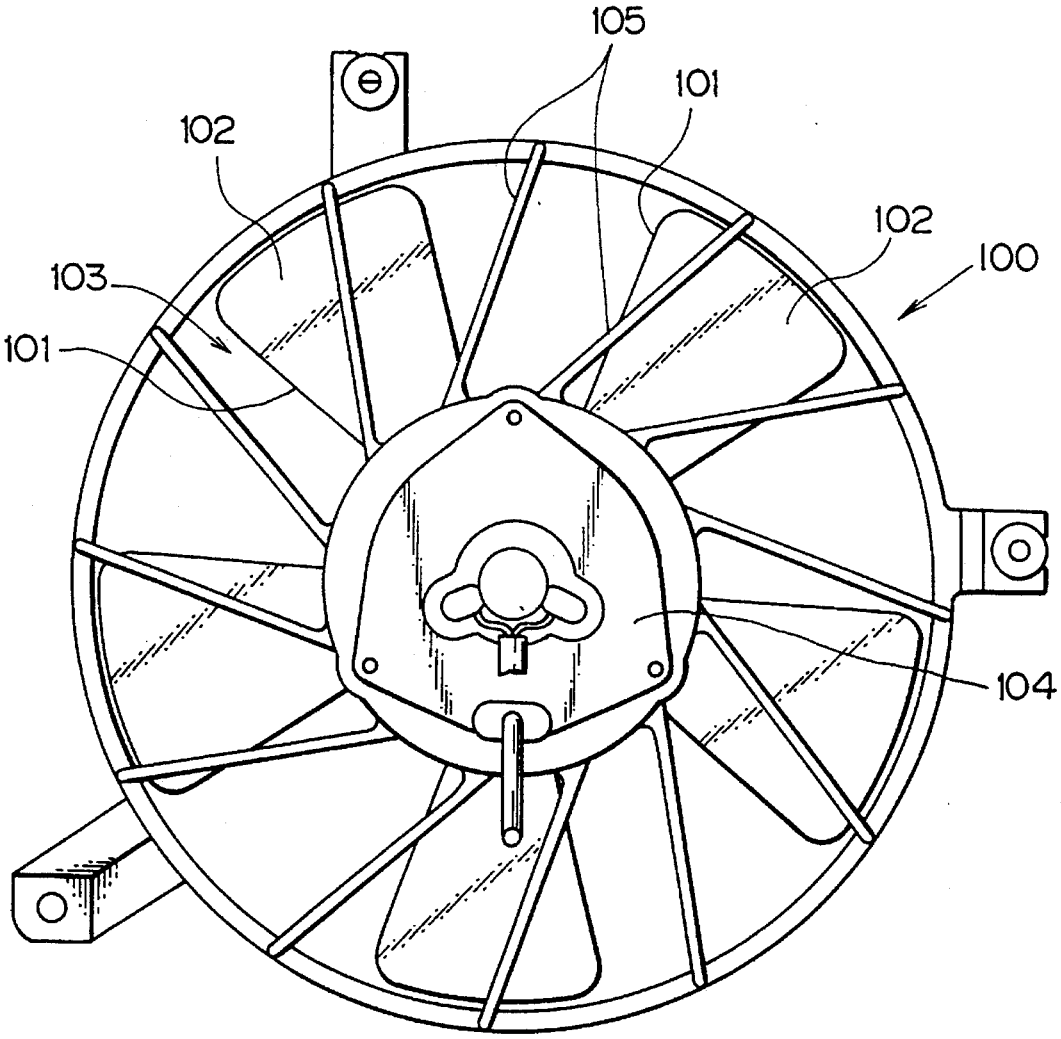
Fig. 13 PRIOR ART
FIG. 13 is a front view of another prior art.
Figure 14:
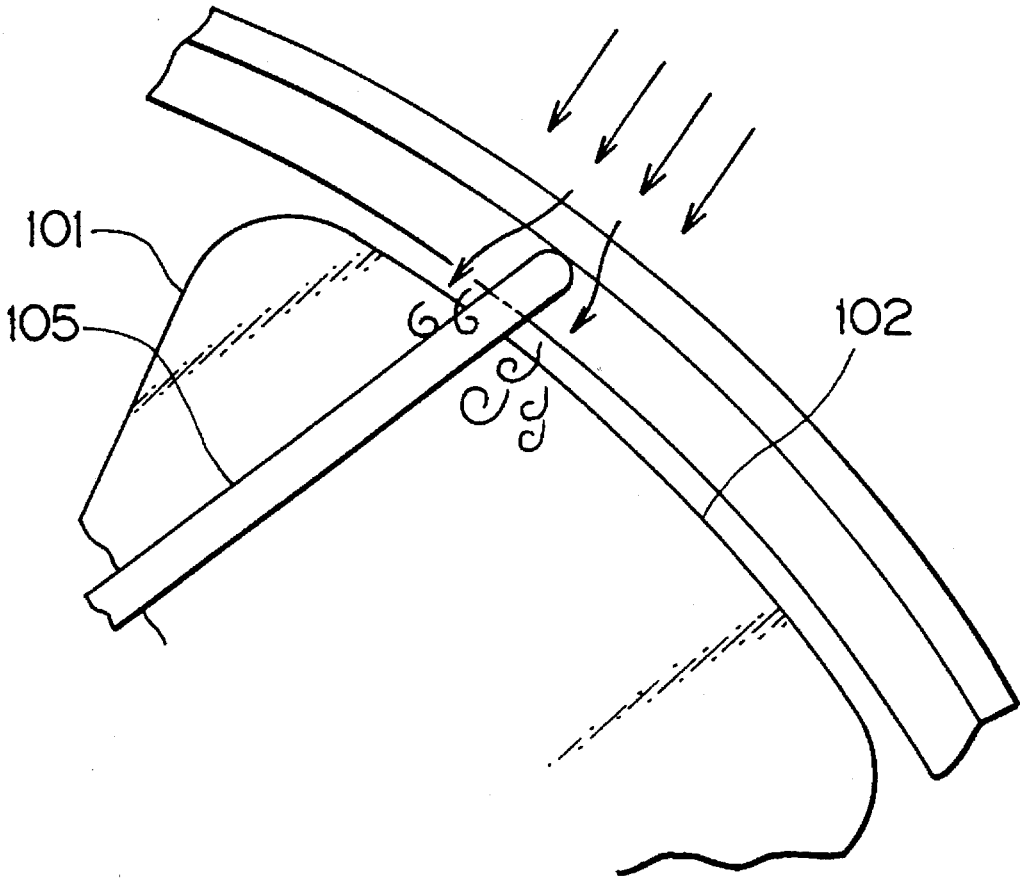
Fig.14 PRIOR ART
FIG. 14 is a partially enlarged view of the blower of FIG. 13.

The fan noise level in this embodiment is shown by the curve A in FIGS. 5 and 6, respectively. The curve A of FIG. 5 shows that the peaks of the interference noise can be reduced by the amount A1, compared with the peaks B1 of the blower having radial vanes of the prior art of FIG. 11. The curve A of FIG. 6 shows that the noise level as a total can be reduced, compared with the curve C of the blower having entirely inclined stays of the prior art of FIG. 13.

As a result, according to the present invention, the total noise and peaks of the noise can be reduced.

Figure 7:
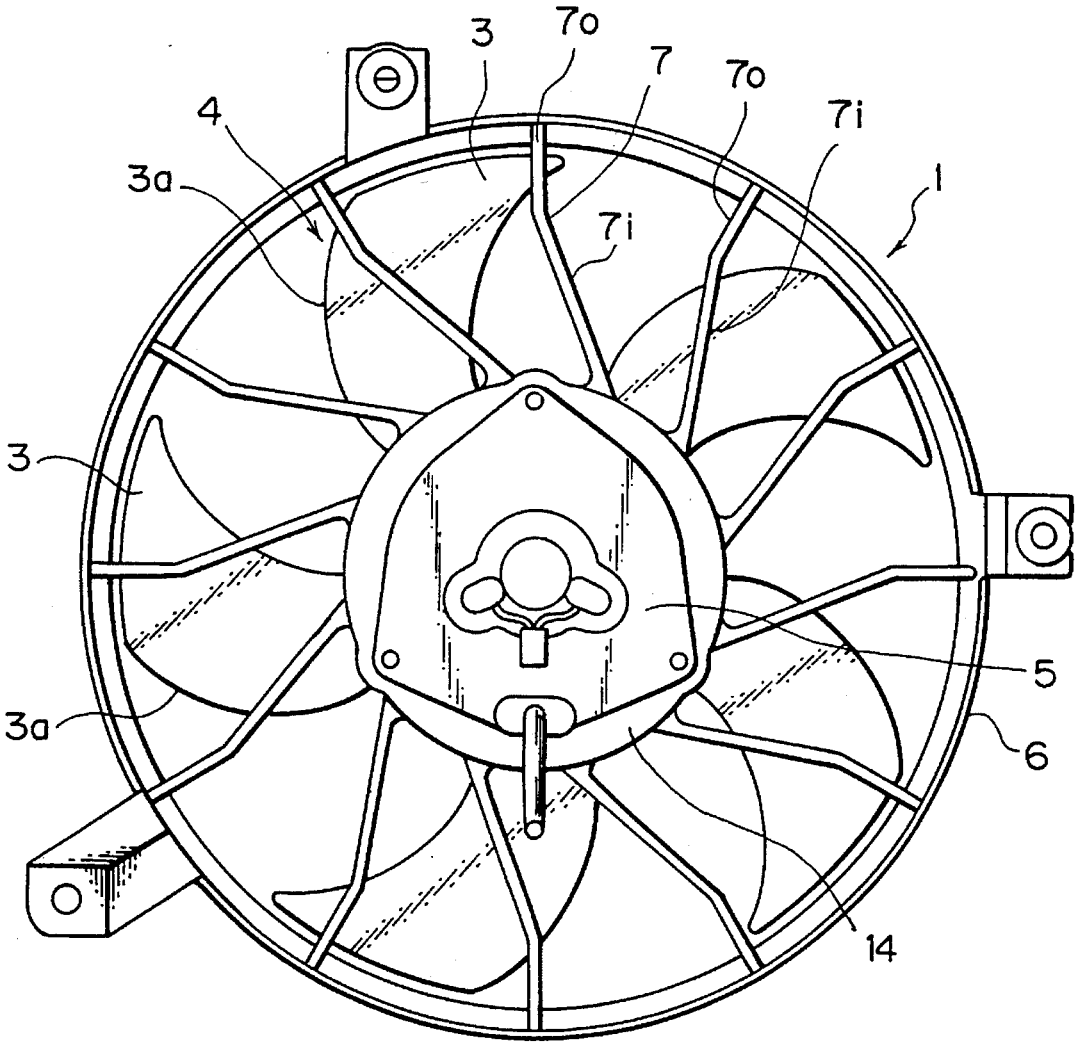
FIG. 7 is a front view of the blower according to the second embodiment of the present invention.

FIG. 7 shows the second embodiment of the present invention. The blower 1 comprises an axial-flow fan 4 with five vanes 3, an electric motor 5 for driving the fan 4 when a voltage is supplied to the motor 5, a generally cylindrical shroud 6 covering the outer periphery of the fan 4, and twelve stays 7 integrally formed with the shroud 6 and the support 14 by a plastic moulding for supporting the motor 5 on the suction side of the fan 4. Each stay 7 is bent and subdivided into an outer portion 7*o* near the outer periphery of the fan 4 and an inner portion 7*i* extending inwardly from the outer portion 7*o* toward the central support 14. The outer portion 7*o* of the stay 7 is arranged along a radial line α about the axis of the fan 4.

Each vane 3 in FIG. 7 is formed in a swept-back shape with the leading edge 3*a* retreating toward the side in reverse to the rotational direction of the fan 4 and the inner portion 7*i* of the stay 7 is arranged at an inclination to a radial line in the rotational direction of the fan 4, while each vane 3 in FIG. 1 was formed in a swept-forward shape and the inner portion 7*i* of the stay 7 was arranged at an inclination to a radial line toward the side in reverse to the rotational direction of the fan 4. It is possible to arrange so that the leading edge 3*a* of the vane 3 intersects the outer and inner portions of the stays 7*o* and 7*i* of the stays 7, respectively, at a relative angle between the leading edge and the stay, the relative angle being greater than a predetermined angle (for example, 30 degrees).

In the above described embodiments, the inner portions 7*i* of the stays 7 are straight. However, it is possible to arrange the inner portions 7*i* of the stays 7 are in a curved shape or a zigzag shape. By arranging the inner portions 7*i* in a zigzag shape, it is possible to absorb an oscillation in a radial direction as well as an oscillation in an axial direction, generated by the motor. It is possible to arrange the outer portions 7*o* of the stays 7. In particular, it is possible to an end part of the outer portion 7*o* located at a position where a radial flow is strong, for example, a part near the shroud 6, is arranged along a radial line.

Figure 8:
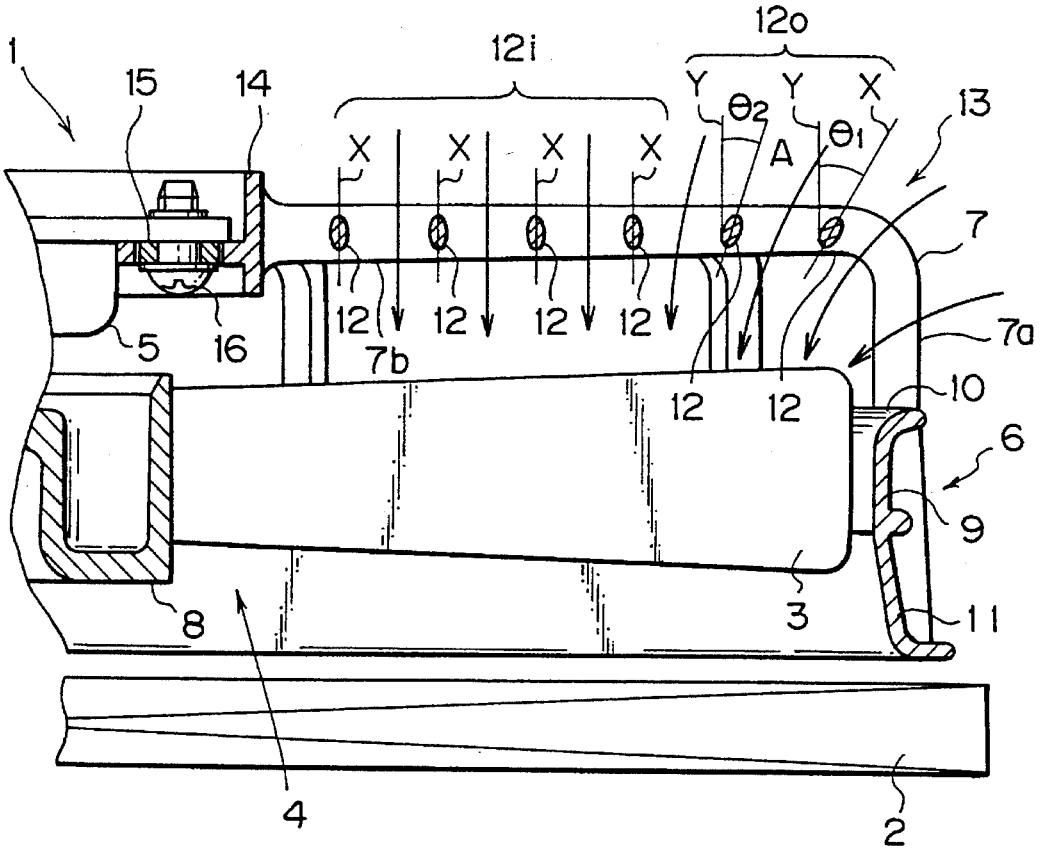
FIG. 8 is a cross-sectional view of the blower according to the third embodiment of the present invention, including a protection net.
Figure 9:
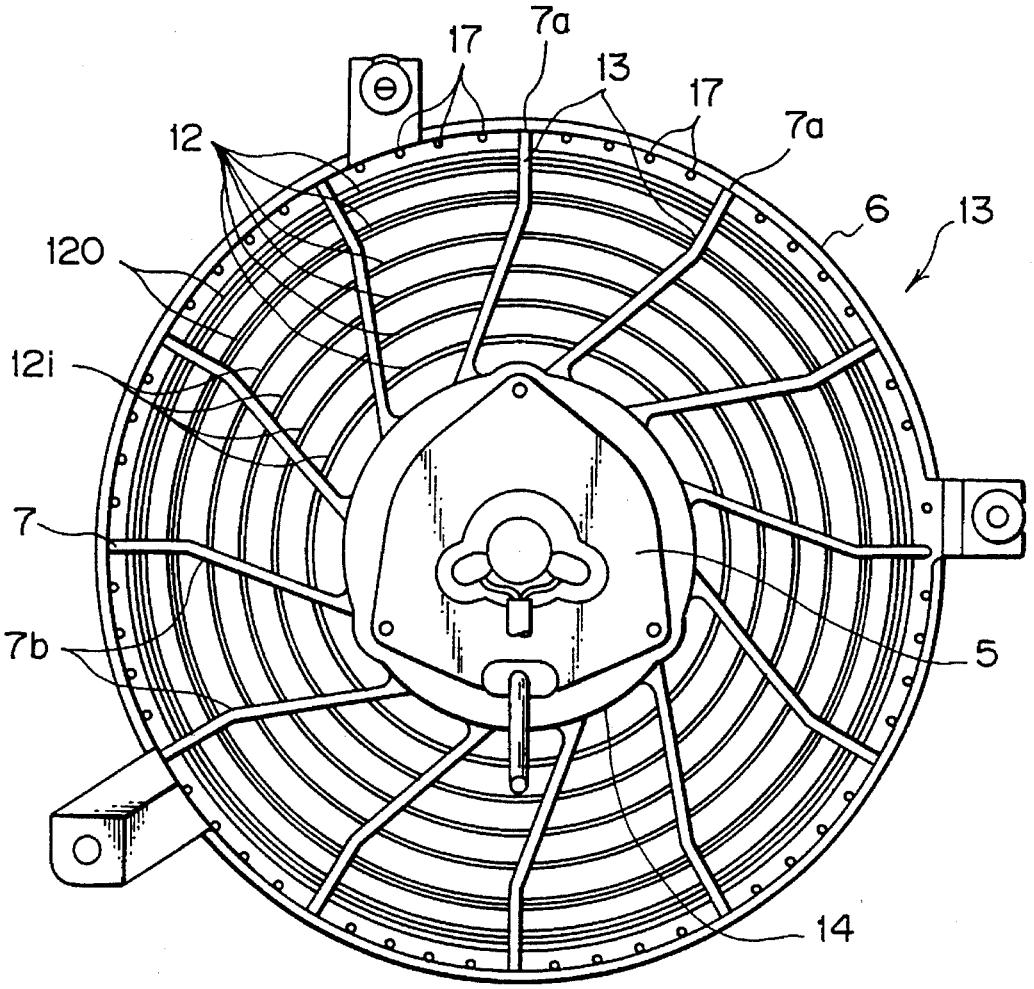
FIG. 9 is a front view of the blower of FIG. 8.

FIGS. 8 and 9 show the third embodiment of the present invention. The blower 1 comprises an axial-flow fan 4 with five vanes 3, an electric motor 5 for driving the fan 4 when a voltage is supplied to the motor 5, a generally cylindrical shroud 6 covering the outer periphery of the fan 4, and twelve stays 7 integrally formed with the shroud 6 and the support 14 by a plastic moulding for supporting the motor 5 on the suction side of the fan 4. Each stay 7 is bent and subdivided into an outer portion 7*o* near the outer periphery of the fan 4 and an inner portion 7*i* extending inwardly from the outer portion 7*o* toward the central support 14. The outer portion 7*o* of the stay 7 is arranged along a radial line α about the axis of the fan 4, and the inner portion 7*i* of the stay 7 is arranged at an inclination to a radial line. The shroud 6 comprises a central cylindrical portion 9, a bell mouth portion 10, and a skirt 11.

The blower 1 in this embodiment further comprises a protection net 13 for preventing the entry of a hand or foreign matter into the fan 4. The protection net 13 comprises the stays 7 and annular ribs 12 integrally formed with the stays 7 for circumferentially interconnecting the adjacent stays 7. Peripheral protection ribs 17 axially project on the outside of the bell mouth portion 10 at a constant pitch on a circle formed by the leg 7*a* of the stays 7. The pitch (for example, approximately 1 cm) of the peripheral protection ribs 17 and the leg 7*a* of the stays 7 is determined to prevent the entry of a hand or foreign matter into the fan 4.

The annular ribs 12 are supported by the stays 7 and face the fan 4. The radial portions 7*b* of the stays 7 are arranged at a spacing from the fan 4 to allow the annular ribs 12 to function, for example in the range from 10 to 20 mm, especially 20 mm in the embodiment. The annular ribs 12 in the embodiment are concentrically arranged at a spacing from each other (for example, approximately 1 cm) so as to prevent the entry of a hand or foreign matter into the fan 4.

Each annular rib 12 has a streamlined cross-sectional shape with a round leading end and a sharp trailing end in view of air flow. Each annular rib 12 has a center line X passing through the leading end and the trailing end.

The center line X of at least one of the annular ribs 12 located near the support 14 is parallel to the axis Y of the fan 4, and the center line X of at least one of the annular ribs 12 located near the shroud 6 is arranged at an inclination to the axis Y of the fan 4 toward the shroud 6. In the embodiment, the center line X of a plurality of annular ribs 12 (represented by 12*i*) are parallel to the axis Y of the fan 4, and the center line X of a plurality of annular ribs 12 (represented by 12*o*) are arranged at an inclination to the axis Y of the fan 4 toward the shroud 6. In the annular ribs 12 located near the shroud 6 (i.e., annular ribs 12*o*), the angle of inclination is greater as the position of an annular rib 12 is located nearer the shroud 16. In the embodiment, the angle of inclination θ1 of the outermost annular rib 12 is greater than the angle of inclination θ2 of the next annular rib 12. The angle of inclination θ1 is in the range from 15 to 45 degrees, and preferably, 30 degrees. The angle of inclination θ2 is 15 degrees.

In operation, the flow of air drawn by the fan 4 is shown by the arrows in FIG. 8. A portion of air flows radially inwardly in the fan 4 and another portion of air flows in parallel to the axis of the fan 4 at the inner portion 7*i* of the fan 4. The annular ribs 12 are arranged so that the center lines X of the annular ribs 12 are parallel to the incoming flow of air, respectively and air flows equally along both surfaces of the annular ribs 12. Therefore, eddies and turbulence in the air flow on the downstream side of the annular ribs 12 is reduced, and thus the noise caused by interference of the vane 3 with the stays 7 and the annular ribs 12 can be reduced.

Figure 10:
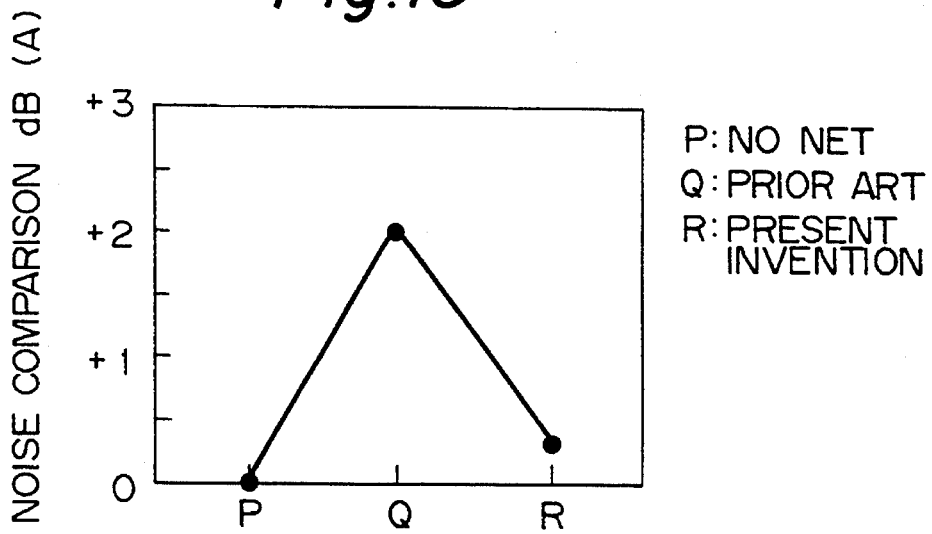
FIG. 10 is a view illustrating the fan noise level with respect to the present invention, a prior art and an example having no net.

FIG. 10 shows the fan noise level with respect to this embodiment, a prior art and an example having no net. The fan noise level regarding this embodiment is shown by the point R, the fan noise level regarding the prior art in which all the annular ribs 12 are arranged parallel to the axis of the fan 4 is shown by the point Q, and an example of a blower having no net is shown by the point P. It is possible to reduce the fan noise level R compared to the fan noise level Q to a level close to the fan noise level P of the no-net example.

The blower 1 for the heat exchanger 2 is arranged in a narrow space in in an automobile and its size must be reduced. If the axial dimension of the annular ribs 12 is reduced, the strength of the protection net 13 is also reduced. In the present invention, the outer annular ribs 12 having a streamlined cross-sectional shape are arranged as an inclination to the axis of the fan 4 and it is possible to increase the longitudinal dimension of the outer annular ribs 12 to a product of ($1/\cos\theta$) by the length of the inner annular ribs 12. This means that the strength of the protection net 13 is increased.

The electric motor 5 is used to drive the fan 4 in the above described embodiment, but it is possible to use other driving means such as a hydraulic motor or a driving force of the engine.

The annular ribs 12 are concentrically arranged circular members in the above described embodiment, but it is possible to use other annular members such as C-shaped or helically shaped annular members.

The present invention can be applied to a blower 1 for delivering air to the heat exchanger 2, but the present invention can be applied to a variety of blowers such as a blower for an air duct or a blower for a combustion device.

We claim:

1. A blower comprising an axial-flow fan having an axis, a plurality of vanes arranged about said axis and defining an outer periphery of the fan, and a suction side:

driving means for driving the fan for inducing a flow of air through the fan;

support means for supporting the driving means at a central region of the fan;

a generally cylindrical shroud covering the outer periphery of the fan;

a plurality of bent stays arranged on the suction side of the fan and integrally formed with the support means and the shroud for connecting the support means to the shroud; and each of the stays comprising an outer portion near the shroud extending along a radial line about the axis of the fan, and an inner portion near the support means extending at an inclination to a radial line about the axis of the fan.

2. A blower according to claim 1, wherein the inner portion of each of the stays is inclined to a radial line about the axis of the fan toward the side opposite to the rotational direction of the fan.

3. A blower according to claim 1, wherein the inner portion of each of the stays is inclined to a radial line about the axis of the fan toward the rotational direction of the fan.

4. A blower according to claim 1, wherein each of the vanes has a leading edge in the air flow, the leading edge being arranged such that the leading edge intersects the outer and inner portions of the stays, respectively, at a relative angle between the leading edge and the stay, the relative angle being equal to or greater than a predetermined angle.

5. A blower according to claim 4, wherein the relative angle is equal to or greater than 30 degrees.

6. A blower comprising an axial-flow fan having an axis, a plurality of vanes arranged about said axis and defining an outer periphery of the fan, and a suction side:

driving means for driving the fan for inducing a flow of air through the fan;

support means for supporting the driving means at a central region of the fan;

a generally cylindrical shroud covering the outer periphery of the fan;

a plurality of bent stays arranged on the suction side of the fan and integrally formed with the support means and the shroud for connecting the support means to the shroud; and each of the stays comprising an outer portion near the shroud extending along a radial line about the axis of the fan, and an inner portion near the support means extending at an inclination to a radial line about the axis of the fan;

a plurality of annular members integrally formed with the stays for circumferentially interconnecting the adjacent stays;

each of the annular members having a streamlined cross-sectional shape with a round leading end and a sharp trailing end in view of air flow, each of the annular members having a center line passing through the leading end and the trailing end; and the center line of at least one of the annular member located near the support means being arranged in parallel to the axis of the fan, the center line of at least one of the annular member located near the shroud being arranged at an inclination to the axis of the fan toward the shroud.

7. A blower according to claim 6, wherein the center line of a plurality of annular members located near the shroud are arranged at an inclination to the axis of the fan toward the shroud, and the angle of inclination is greater as the annular member is located nearer the shroud.

* * * * *